US007370375B2

(12) United States Patent
Phillips

(10) Patent No.: US 7,370,375 B2
(45) Date of Patent: May 13, 2008

(54) SYSTEM AND METHOD OF HEATING SWIMMING POOLS AND SPAS WITH STEAM

(76) Inventor: Keith A. Phillips, 9701 E. La Posada Cir., Scottsdale, AZ (US) 85255

( * ) Notice: Subject to any disclaimer, the term of this patent is extended or adjusted under 35 U.S.C. 154(b) by 77 days.

(21) Appl. No.: 10/841,735

(22) Filed: May 6, 2004

(65) Prior Publication Data

US 2005/0066434 A1 Mar. 31, 2005

Related U.S. Application Data

(63) Continuation-in-part of application No. 10/671,843, filed on Sep. 25, 2003, now abandoned.

(51) Int. Cl.
*E04H 4/12* (2006.01)

(52) U.S. Cl. ..... 4/493; 4/492; 239/432; 239/524; 36/DIG. 10

(58) Field of Classification Search ..... 4/492, 4/493; 122/36, DIG. 10; 239/432, 524, 239/553, 533.3, 553.5
See application file for complete search history.

(56) References Cited

U.S. PATENT DOCUMENTS

| | | | | | |
|---|---|---|---|---|---|
| 136,128 | A | * | 2/1873 | Bralley | 4/493 X |
| 3,207,133 | A | * | 9/1965 | Andersen | 4/493 X |
| 3,291,119 | A | * | 12/1966 | Sullivan | 4/493 X |
| 3,756,220 | A | * | 9/1973 | Tehrani et al. | 4/493 X |
| 3,837,016 | A | | 9/1974 | Schindler et al. | |
| 4,137,574 | A | | 2/1979 | Collins | |
| 4,373,908 | A | * | 2/1983 | Petit et al. | 239/553.5 X |
| 4,520,514 | A | * | 6/1985 | Johnson | 4/492 X |
| 4,571,484 | A | | 2/1986 | Singfield | |
| 4,754,502 | A | | 7/1988 | Bowen | |
| 4,903,352 | A | * | 2/1990 | Murakami | 4/492 X |
| 5,253,378 | A | | 10/1993 | Jung, Jr. | |
| 5,551,331 | A | | 9/1996 | Pfeifer et al. | |
| 5,606,964 | A | | 3/1997 | Bussman | |
| 5,893,341 | A | | 4/1999 | Cox | |
| 5,915,071 | A | | 6/1999 | Harbin, III | |

* cited by examiner

*Primary Examiner*—Robert M. Fetsuga
(74) *Attorney, Agent, or Firm*—Robert D. Atkins; Quarles & Brady LLP

(57) ABSTRACT

A dual water heating system uses a pump for pumping water from a swimming pool or spa. A filter is coupled to an output of the pump for filtering the water. A water heater heats the water and returns heated water to the swimming pool or spa. A network of non-corrosive piping is disposed within the swimming pool support structure. A plurality of steam ports are coupled to exit points of the network of piping. A steam generator provides steam to the network of piping for transporting the steam to the steam ports and injecting the heated water into the swimming pool or spa. An energy source supplies energy to the steam heater. A motorized or hand-push cart is used to transport the steam heater and energy source. The steam ports are provided along sidewalls or bottom surface of the swimming pool and spa support structure. The steam ports are contained within cavities formed in the support structure.

28 Claims, 6 Drawing Sheets

SYSTEM AND METHOD OF HEATING SWIMMING POOLS AND SPAS WITH STEAM

CLAIM TO DOMESTIC PRIORITY

The present patent application is a continuation-in-part of patent application Ser. No. 10/671,843, filed Sep. 25, 2003 now abandoned, entitled "System and Method of Heating Swimming Pools and Spas with Steam", by Keith A. Phillips.

FIELD OF THE INVENTION

The present invention relates in general to water heating systems and, more particularly, to a system and method of heating swimming pools and spas with steam created from a steam generation source and injected into the pool or spa.

BACKGROUND OF THE INVENTION

People enjoy swimming pools and spas for family activities, therapy, exercise, recreation, and relaxation. Swimming pools are less popular in colder climates, but still find uses in the summer months and indoor settings. In warmer climates, swimming pools are common in residences, hotels, resorts, and health clubs. Spas and hot tubs are found in all types of climates.

In general, people tend to enjoy pools and spas more when the water is relatively warm and pleasant. In swimming pools, some people find 75-80° F. water to be refreshing; other people find 85-90° F. water to be more comfortable. In spas, the water is generally even warmer in the 100-105° F. range. Depending on the time of year and outside air temperature, it is often necessary to heat the pool and spa water to the desired temperature. Most if not all spas and hot tubs include heaters to increase the temperature of the water to higher levels. In swimming pools, heaters have been used to extend the usable season and even make the pool a year-round attraction.

Swimming pool and spa heaters come in basic configurations where water is pumped from the main body of water, filtered, and then heated before returning to the pool. The most common types of filters are sand, diatomaceous earth, and cartridge. The filtered water is routed through heating chambers in the heater before returning to the main body of water. The heater can burn propane or natural gas as an open flame, which is applied directly to the heating chamber to increase the water temperature. Electricity can also be used as an energy source to power a heating element placed in proximity to the heating chamber. The heating element transfers heat to the heating chamber, which in turn increases the temperature of the return water to the pool or spa. In another embodiment, the return water is routed through solar collectors to increase its temperature.

A common problem with conventional heating systems for swimming pools and spas is that the user must either keep the water at the desired temperature at all times, even when the pool is not in use, or the user must allow for the time needed to increase the water temperature to a comfortable level. Keeping the water at a continuous warm temperature increases operating costs, wastes energy, and unnecessarily consumes natural resources. On the other hand, the process of increasing the water temperature to a comfortable level when it comes time to use the pool can take a considerable amount of time. If the pool water is initially at a low temperature, say 50° F., it may take many hours, or an entire day, to raise the temperature to say 80° F., depending on the energy transfer capacity of the heater and volume of pool water. The pool user must plan ahead to have the pool ready to use at the intended time. The requirement to plan ahead limits the spontaneity and enjoyment factor associated with using the pool or spa. Many times the user foregoes the use of the pool because it takes too long to heat the water or requires too much preparation effort.

SUMMARY OF THE INVENTION

In one embodiment, the present invention is a water heating system comprising a steam heater for generating steam. A wand injects the steam into a body of water. A flexible tubing is coupled between the steam heater and wand to transfer the steam from the steam heater to the wand.

In another embodiment, the present invention is a water heating system for heating a body of water comprising a network of piping disposed within a support structure containing the body of water. A plurality of steam ports are coupled to exit points of the network of piping for directing heated water into the body of water. A steam generator provides steam to the network of piping for transporting the steam to the steam ports and heating the body of water.

In another embodiment, the present invention is a water heating system for heating a body of water comprising a pipe disposed within a support structure containing the body of water. A first cavity is formed within the support structure. A steam port is disposed within the first cavity and coupled to an exit point of the pipe.

In another embodiment, the present invention is a method of heating a body of water, comprising providing a pipe for disposing within a support structure containing the body of water, and providing a steam port on an exit point of the pipe for directing heated water into the body of water.

DETAILED DESCRIPTION OF THE DRAWINGS

The present invention is described in one or more embodiments in the following description with reference to the Figures, in which like numerals represent the same or similar elements. While the invention is described in terms of the best mode for achieving the invention's objectives, it will be appreciated by those skilled in the art that it is intended to cover alternatives, modifications, and equivalents as may be included within the spirit and scope of the invention as defined by the appended claims and their equivalents as supported by the following disclosure and drawings.

Figure 1:
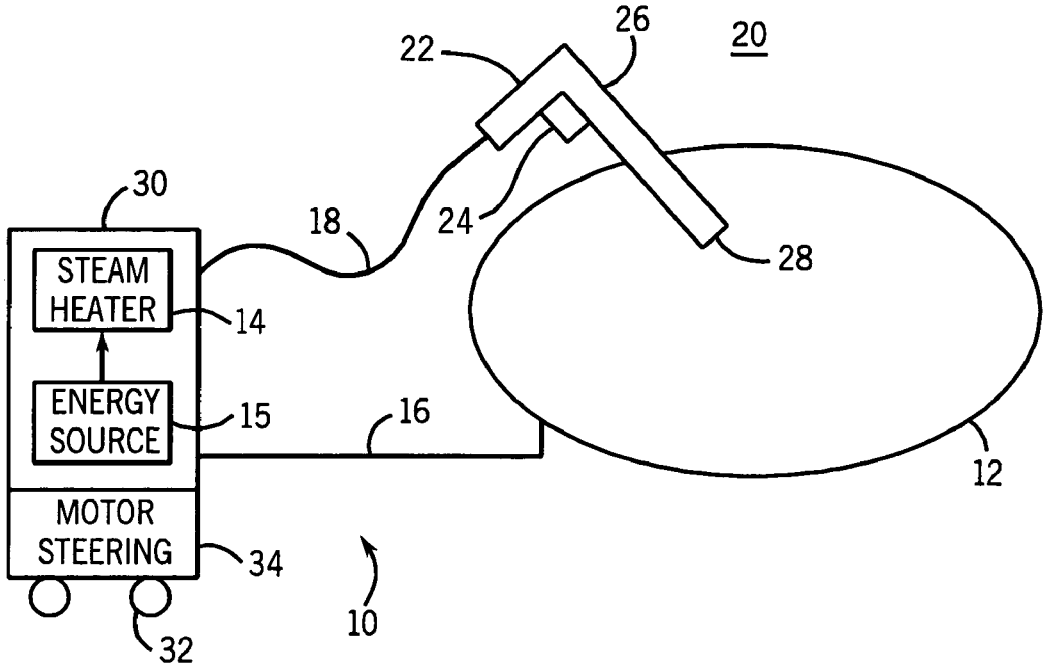
FIG. 1 illustrates a portable steam heater for swimming pools and spas with hand-held wand.

Referring to FIG. 1, a steam heater system 10 is shown for heating a body of water 12. Swimming pools, spas, and hot tubs are examples of body of water 12 and range in size from a few hundred gallons for spas to 20,000-40,000 gallons or more for swimming pools. In the interest of clarity, the elements shown in the figures are representative of the described function and are not necessary drawn to scale.

People find enjoyment in the use of swimming pools, spas, and hot tubs for family activities, therapy, exercise, recreation, and relaxation. While water-based activities are less popular in colder climates, these recreational facilities are still commonly used in the summer months and indoor settings. In warmer climates, swimming pools are found in residences, hotels, resorts, and health clubs. Spas and hot tubs are found in all climates. The present invention involves the use of steam to rapidly heat swimming pool and spa water. By heating the water with steam, the swimming pool and spa can be heated at will, relatively quickly, and only when needed thus saving time, energy, and conserving natural resources.

Steam heater or generator 14 draws energy from energy source 15 to generate steam. Energy source 15 may be natural gas, propane, or other fossil fuel. Energy source 15 could also be electrical, solar, hydrogen-based, chemical, or other suitable energy source. Steam heater 14 draws water from pool 12 through pipe or flexible tubing 16. Alternatively, steam heater 14 could get its water from an external water supply, e.g., a water main. The combination of energy from energy source 15 and water from pool 12 allows steam heater 14 to generate superheated steam, i.e., above the boiling point of water. The steam is transferred through flexible tubing 18 to gun or wand 20. Tubing 18 is made from non-corrosive material such as stainless steel having flexible linkages. Gun 20 is configured to be hand-held with a hand grip 22 and trigger assembly 24. An operator holds hand grip 22 in one hand and operates trigger assembly 24 with his or her index finger. The second hand grasps barrel 26 for control and stable operation. The non-corrosive conduit runs through grip 22 and barrel 26 to transfer the steam to exit point 28. Barrel 26 is made from graphite, plastic, polymer, or other thermal material for insulation from the superheated steam. Tubing 18 is also thermally insulated to protect the operator from the hot steam.

The operator positions gun 20 such that exit point 28 is underwater in pool 12. The operator then squeezes trigger 24 and causes steam to flow from steam heater 14 through tubing 18 and gun 20. The steam is injected directly into pool 12. The application of superheated steam to pool 12 causes the temperature of the water to increase relatively quickly. For example, in a 15,000 gallon pool with 212° F. steam injected into pool 12, the water temperature increases at a rate of 10° F. per hour with a steam mass flow rate of 1300 lbs/hr. In the case of a 500 gallon spa, steam heater system 10 producing the same 212° F. steam will increase the water temperature at a rate of 60° F. per hour with a steam mass flow rate of 260 lbs/hr. The rate of increase in water temperature in pool 12 is much greater with steam injected into the water as compared to conventional pool heating systems. Steam heater system 10 provides a significant convenience for the operator and user of pool 12 in that the body of water can be heated much more rapidly making the swimming pool or spa ready for use within a shorter period of time. The rate of increase in water temperature is even greater with superheated steam greater than 212° F. The swimming pool and spa can be heated at will, relatively quickly, and only when needed thus saving time, energy, natural resources, and maintenance over conventional heating systems.

Steam heating system 10 is a portable unit. Steam heater 14 and energy source 15 can be attached to a cart or dolly 30 with wheels or rollers 32. Tubing 16 can be a flexible hose that is readily moved and laid on the decking of pool 12. Tubing 18 and gun 20 are part of the portable unit. The portable steam heater can be moved from place to place by pushing cart 30 by hand. A motor and steering assembly 34 can be attached to cart 30 for mechanized operation and maneuvering heavier capacity steam generating equipment. The operator controls motor and steering assembly 34 to drive cart 30 to the desired location. The portable steam heater system 10 is useful for hotels, clubs, resorts, and municipal pools that have more than one swimming pool or spa to maintain. One steam heater system 10 can service one or more swimming pools and spas.

Figure 2:
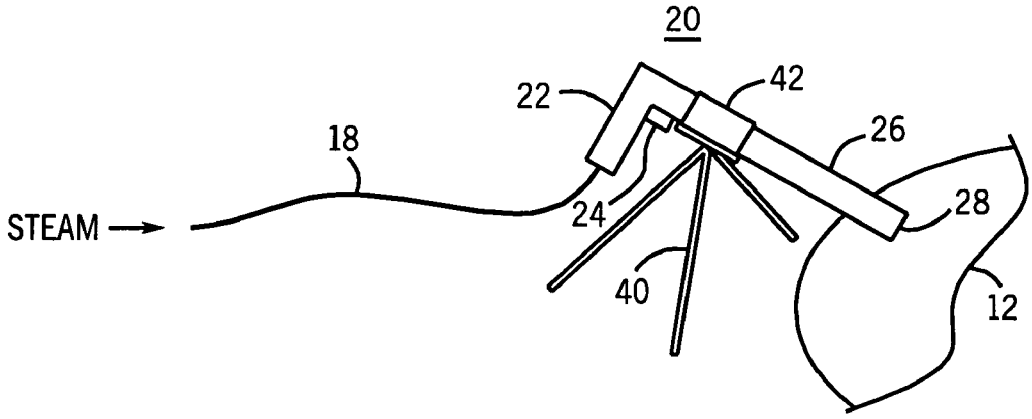
FIG. 2 illustrates the portable steam heater with a stand to support the wand.

Another feature of portable steam heater system 10 is shown in FIG. 2. Elements having a similar function are assigned the same reference number. In this case, wand or gun 20 is supported by brace or stand 40. For larger bodies of water which take longer to heat, or in situations where the operator does not want to hold the hand-held version of gun 20, brace 40 supports gun 20 while the steam is injected into pool 12. Gun 20 is positioned in support channel 42 on brace 40 with exit point 28 underwater and then locked or clamped securely in place. Trigger assembly 24 is engaged and locked. The superheated steam is pumped into pool 12. The operator can observe from a comfortable distance or perform other duties while the water temperature of pool 12 is brought to the desired temperature. A warning sign can be placed on brace 40 to avoid accidents and prevent injury to swimmers, guests, and passersby when the steam heating process is underway.

Figure 3:
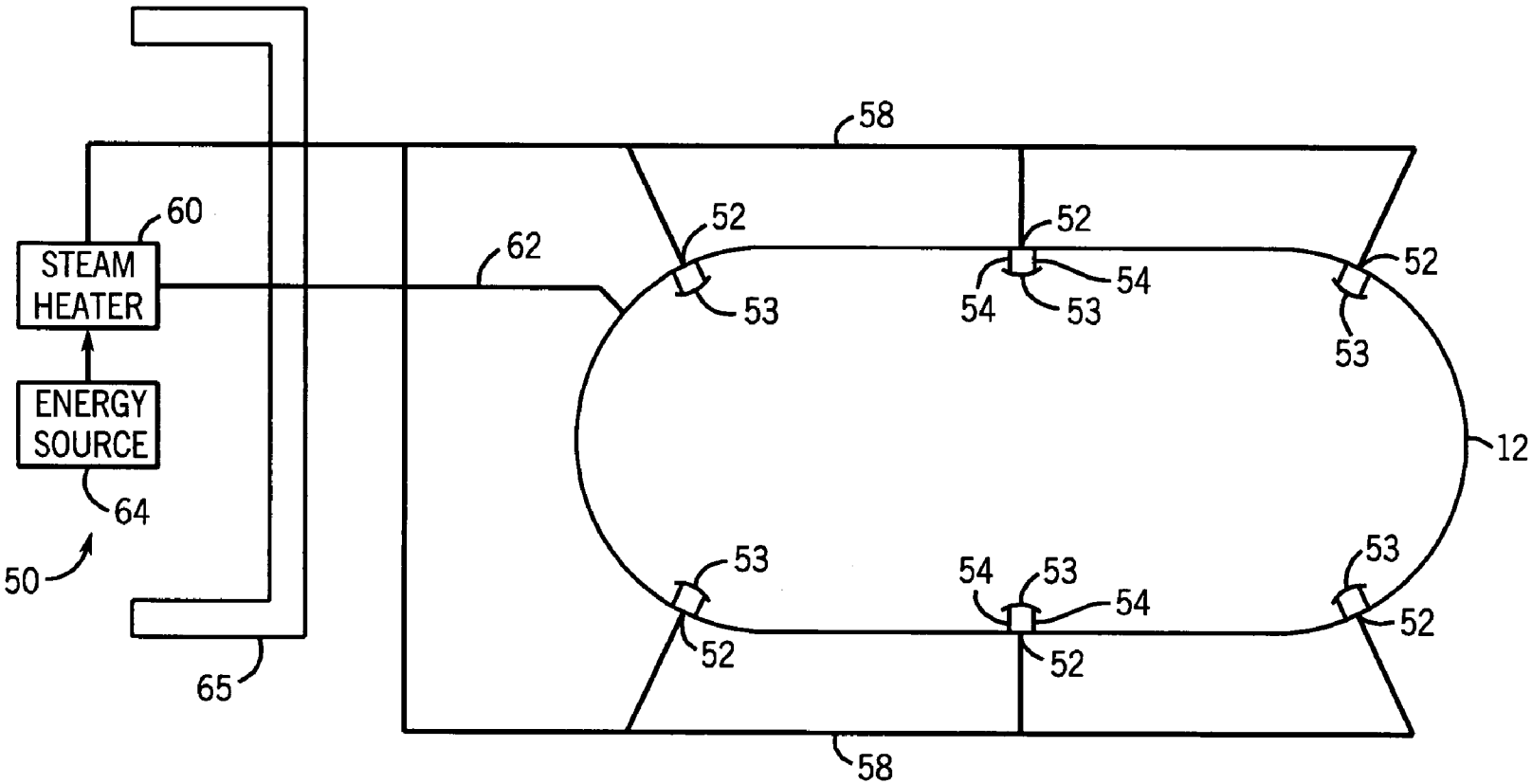
FIG. 3 illustrates a fixed steam heater with a delivery system integrated into the support structure.

Another steam heater system 50 is shown in FIG. 3. Pool 12 is built or modified to have a plurality of steam ports 52. Steam ports 52 are positioned at regular intervals around the side walls under the waterline and along the bottom of pool 12. Steam ports 52 include a jet or orifice for injecting the steam into the water. Each steam port 52 also includes a protective plate 53 that re-directs the steam-heated water in multiple directions as a safety measure. Cover plate 53 is supported by braces or rods 54 that allow water and steam to exit into the main body of pool 12 from the sides of the protective plate.

Figure 4:
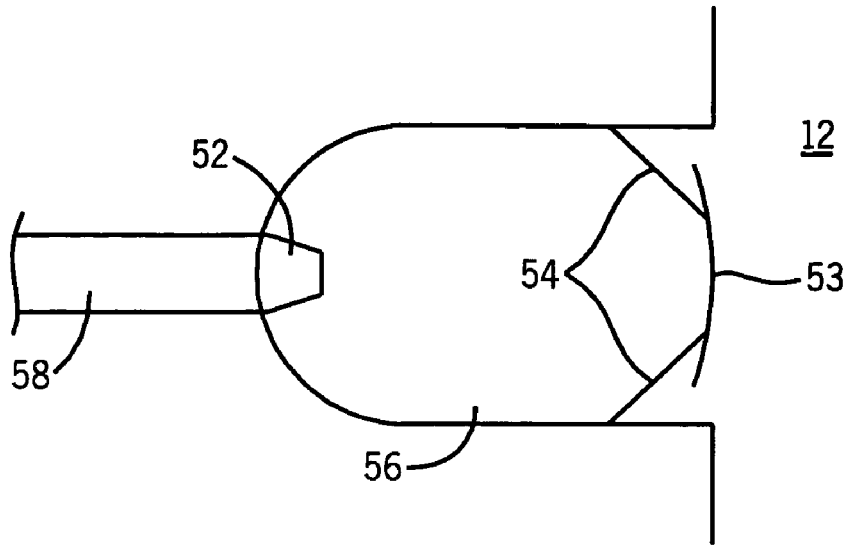
FIG. 4 illustrates a cover plate mounted flush to the pool wall and steam port recessed into the pool support structure.

Cover plate 53 may be mounted substantially flush to the side or bottom of pool 12, in which case, steam port 52 is recessed into a cavity 56 in the support structure of pool 12, as shown in the cross-sectional view of FIG. 4. Steam port 52 is mounted within cavity 56 formed in the support structure of pool 12. The steam strikes protective plate 53 and is re-directed sideways and flows through a gap between the protective plate and support structure into the main body of pool 12. The steam-heated water cools as it mixes with the pool water. Thus, by using protective plates 53, swimmers and bathers are less likely to be directly exposed to the superheated steam jets.

Returning to FIG. 3, a network of non-corrosive pipes or conduit 58 is contained within the support structure of pool 12 and transfers the steam from steam heater 60 to steam ports 52. The support structure includes the soil, rebar, concrete, gunite, decking, and inner pool surface which forms the shell of pool 12. The network of pipes 58 and steam ports 52 with protective plates 53 constitute the steam delivery system integrated into the swimming pool and spa support structure.

In one embodiment, steam heater 60 is a fixed unit, permanently coupled to pipes 58. Water is drawn from pool 12 through tubing or pipe 62 for steam heater 60. Energy source 64 provides energy to heat the water from pool 12. The energy source can be electrical, solar, natural gas, propane, and other fuel sources as described above. The heated water is converted to steam. In a fixed configuration, steam heater 60 and energy source 64 may be placed behind a wall 65 for safety and aesthetic appearance. In the unlikely event that steam heater 60 should fail or burst, wall 65 will provide safety and protection for against serious injury to people.

The operator engages steam heater 60. Steam heater 60 detects the temperature of the pool water drawn from pipe 62 to determine whether or not the water temperature in pool 12 needs to be increased with respect to a user-selected setting on steam heater 60. Energy from energy source 64 boils the water under pressure to create superheated steam. The steam flows from steam heater 60 through the network of pipes 58 and is injected, directly or indirectly, into pool 12 through steam ports 52. The steam causes heated water to flow around protective plates 53 and into pool 12. The application of superheated steam causes the temperature of the pool water to increase rapidly. Again, the rate of increase in water temperature in pool 12 is much greater with the present steam heating system as compared to conventional pool heating systems. The distributed steam ports 52 of steam heating system 50 along the sidewalls or bottom of pool 12 provides a convenient and safe mechanism for injecting steam directly or indirectly into the pool.

Figure 5:
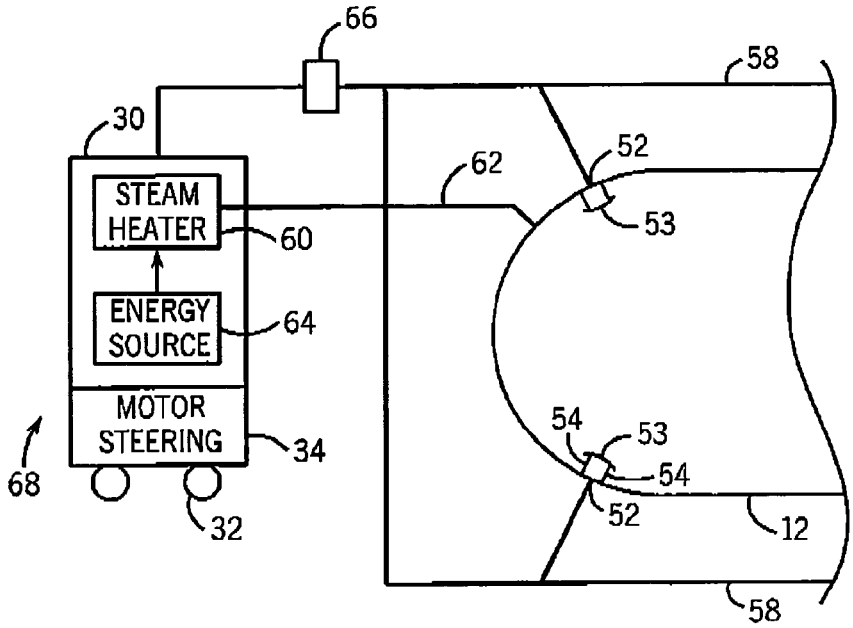
FIG. 5 illustrates a portable steam heater and detachable coupling to the steam delivery system.

A significant portion of the cost for steam heating system 50 is attributable to steam heater 60 and energy source 64. For installations having multiple swimming pools and spas, a portable version of the steam heating system allows the unit to be moved around and shared. Accordingly, as shown in FIG. 5, steam heater 60 and energy source 64 are housed in portable cart 30. A detachable coupling 66 is provided for quick and easy connect and disconnect between steam heater 60 and pipes 58. The portable steam heater system 68 is maneuvered around and connected via detachable coupling 66 to pipes 58 for different swimming pools and spas as needed.

In some applications, the steam heater system is the primary and sole heating source for the swimming pool and spa. In such cases, the steam heater system will replace the conventional pool heater. The rapid heating cycle of the steam heating system gives the user the option of not heating the swimming pool and spa during non-usage time. For example, residential swimming pools and spas are generally not heated at night and during the work week. In many situations, no one is using the swimming pool and spa during those times. A significant amount of energy can be saved by not heating the pool and spa water when it is not in use. When the user wants to heat the swimming pool and spa water, he or she fires up the steam heating system and increases the water temperature to a comfortable level in a short time. The steam heating system can be engaged during the weekends and holidays when the pool and spa are regularly used.

Figure 6:
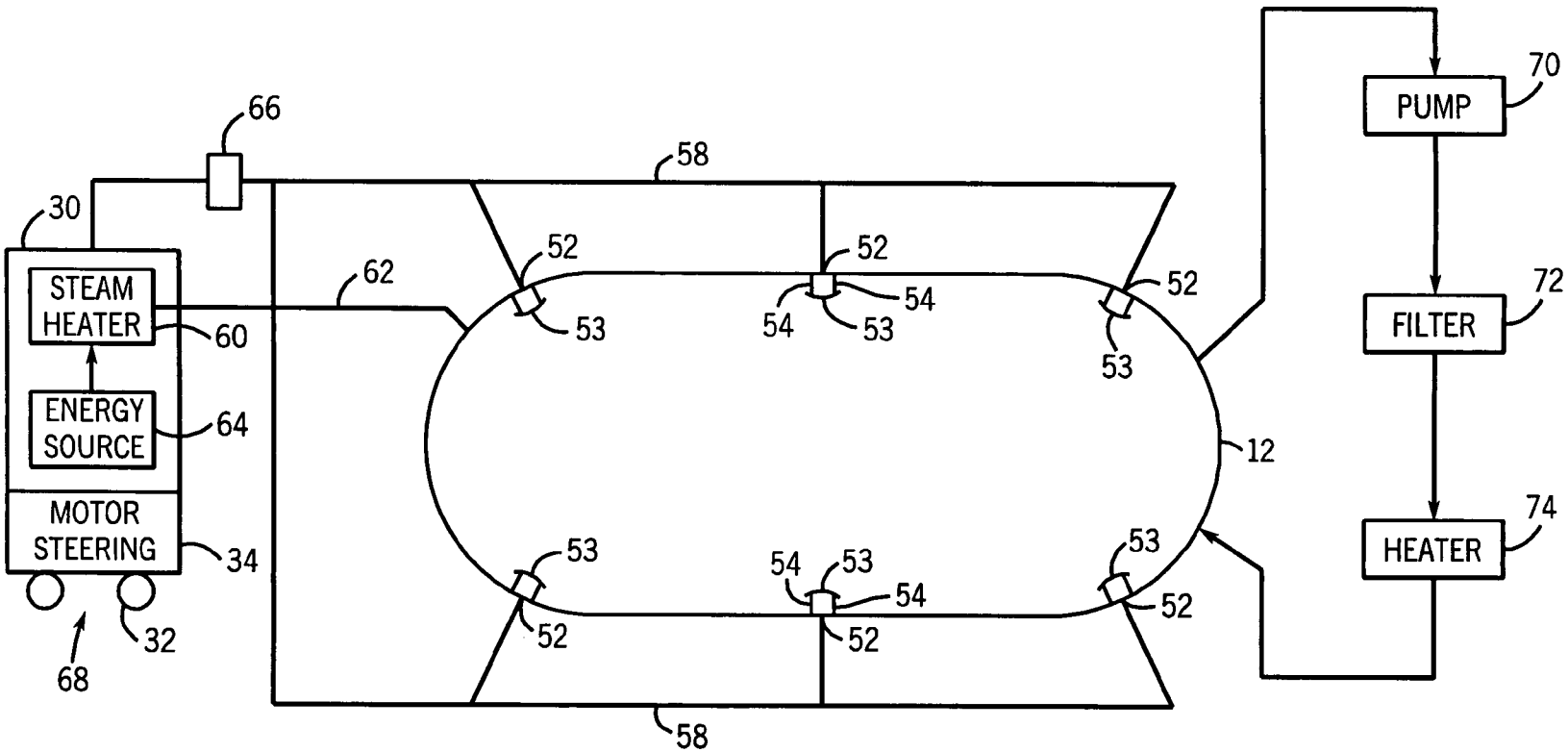
FIG. 6 illustrates a dual water heating system.

In other applications, especially in multiple pool and spa installations, a dual water heating system such as shown in FIG. 6 is used. A conventional water heating system is capable of maintaining the water at a given level. Water is pumped from pool 12 by pump 70 and run through filter 72 and heater 74 back to pool 12. Heater 74 includes a heating chamber which the filtered return water flows through. The heating chamber is exposed to a heating source such as a natural gas flame or electric heating element. In a dual water heating system, portable steam heating system 68 is used as a booster heating system to rapidly increase the water temperature to the desired level. In other words, given that the swimming pool and spa water is initially cold, the portable steam heater 68 is positioned and utilized to rapidly heat the water to a comfortable temperature. Once the water temperature reaches the desired level, the conventional heater 74 takes over to keep the pool water at the desired temperature. Heater 74 can be a smaller unit since it is only maintaining the water temperature that steam heating system 68 has established.

In the case of portable steam heating system 10 or 68, the portable steam heater can be disengaged and moved. In multiple pool and spa installations, the portable steam heating system is taken to the next pool or spa to repeat the rapid heating process. Again, once the water temperature reaches the desired level, the conventional heating system takes over and maintains the water temperature. The portable steam heater system is then moved to the next job. The dual water heating system is convenient in multiple pool and spa installation in that the portable steam heating system does not have to be repeatedly moved from location to location to continuously re-heat the water. The portable steam heater system is used for its primary purpose, i.e., to rapidly heat the pool and spa water and then allow the conventional heater to take over.

Figure 7:
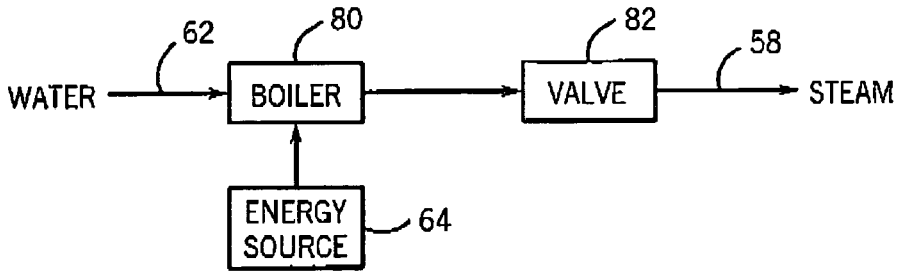
FIG. 7 illustrates a block diagram of the steam heater.

Further detail of the steam heater is shown in FIG. 7. Using steam heater 60 as an example, a boiler 80 receives water from tubing 62. Boiler 80 is heated from energy source 64. An open flame from the burning natural gas or an electrical heating element boils the water under pressure in boiler 80 to generate steam. By increasing the temperature of the steam past 212° F., the steam becomes superheated. The steam in boiler 80 is kept at a temperature of about 24° F. and pressure of 10 PSIG. A thermostat detects the water coming from pipe 62 and enables and disables steam heater 60. The superheated steam is released by valve 82 into the network of pipes 58.

In another embodiment, the steam heater can be implemented with an instant steam generator. The instant steam generator receives a continuously supply of water. Air is driven into a mixer-burner, combined with fuel, and ignited in a chamber. The water is sprayed into the hot gases exiting the chamber to create instant steam. The water is instantly converted to super-heated steam in an efficient manner. A blower provides a force behind the steam to move it rapidly down the conduit to the swimming pool.

In some areas, governmental codes and other safety concerns may require that the super-heated steam not come in direct contact with the main body of water. Otherwise, a person in the water near the steam jets could be burned or injured. In such cases, the steam heating system injects the super-heated steam into the water flow some distance away from the main body of water.

Figure 8:
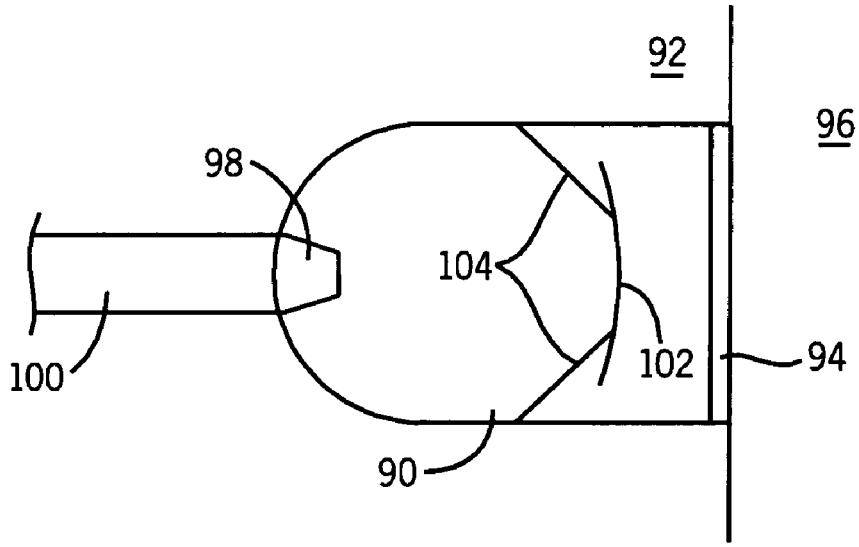
FIG. 8 illustrates a steam jet disposed within a cavity of the pool structure.

In FIG. 8, a cross-section view of swimming pool sidewall or bottom is shown. A cavity 90 is formed in swimming pool sidewall or bottom 92. A cover plate 94 is placed over cavity 90 flush with sidewall 92. Cover plate 94 is grated or perforated with openings to allow water to freely pass from cavity 90 to the main body of water 96. Steam jet or port 98 is positioned at the inner most portion of cavity 90. Steam jet 98 connects to tubing 100, which in turn connects to steam generation source. A protective plate 102 is supported by braces or rods 104 and placed in the path of the steam jet nozzle to re-direct and disperse the steam within cavity 90. As the steam exits steam jet 98, it mixes with the pool water in cavity 90. The heated pool water flows out cover 94 and heats the main body of water 96. The steam indirectly heats the water in pool 96 by injection into cavity 90.

In another embodiment, cavity 90 may be located deeper within the swimming pool structure, or farther from the pool water, and connected to the main body of water 96 with a pipe to transfer the heated water into the pool.

Figure 9:
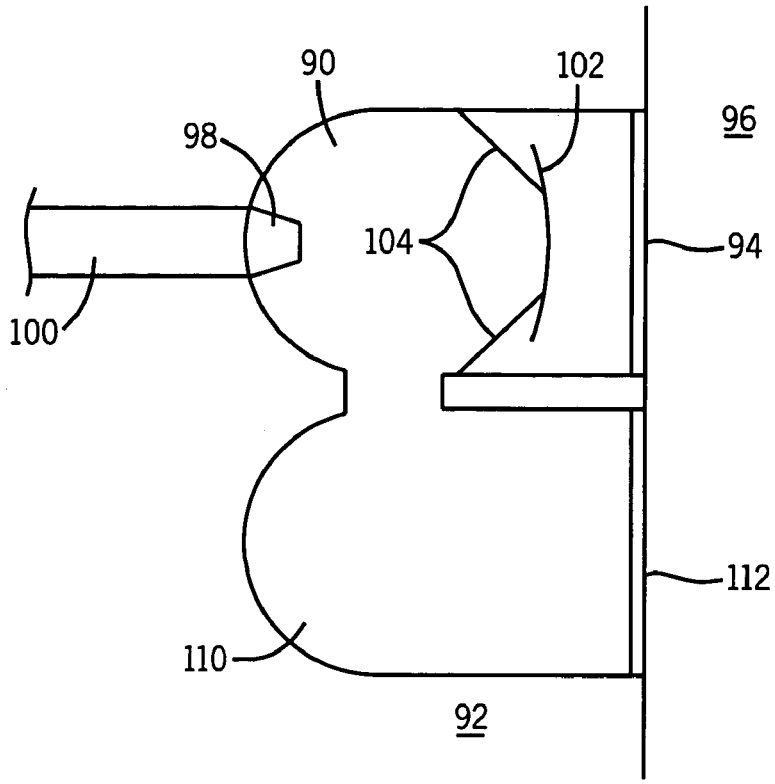
FIG. 9 illustrates a steam jet disposed within a first cavity and a second cavity supplying water to the first cavity.

A second cavity 110 in sidewall 92 is shown in FIG. 9. Cavity 110 may be formed adjacent to cavity 90. Alternative, cavity 110 can be formed around a portion or all of cavity 90. For example, cavity 90 may be a smaller enclosure placed within larger enclosure or cavity 110. Alternatively, cavity 110 may be one or more channels or pipes within the support structure connecting the main body of water 96 to cavity 90. In any case, cavity 110 connects with cavity 90 to allow water to freely flow between the two cavities. Cavity 110 has a grated cover plate 112 exposed to the main body of water 96.

Water is drawn from the main body of water 96 through cover plate 112 into cavity 110. The pool water passes from cavity 110 into cavity 90 by the connection or opening between the cavities. The water is heated by steam jet 98 and flows out cover plate 94 to heat the main body of water 96. The pressure from steam jet 98 forces heated water from cavity 90 into the main body of water 96. Thus, the pressure from steam jet 98 creates a suction of water from cavity 110 into cavity 90. The suction causes a circulating action from the main body of water 96 into cavity 110 and then into cavity 90. The heated water in cavity 90 is returned to the main body of water 96. The second cavity 110 replenishes water from the pool into cavity 90 for heating by steam jet 98.

Figure 10:
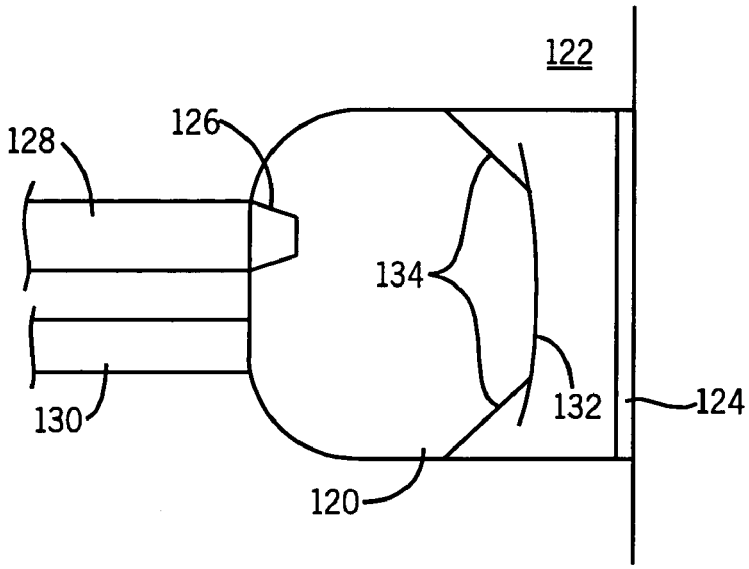
FIG. 10 illustrates a steam jet disposed within a cavity of the pool structure and the filter return line supplying water to the cavity.

In another embodiment, a cavity 120 is formed in sidewall or bottom 122 of the pool support structure, as shown in FIG. 10. A grated cover plate 124 is placed over cavity 120 flush with sidewall 122. Steam jet or port 126 is positioned within cavity 120. Steam jet 126 connects to tubing 128, which in turn connects to steam generation source. Water return pipe 130, from the pool filter, is also located within cavity 120. A protective plate 132 is supported by braces 134 and placed in the path of the steam jet nozzle to re-direct and disperse the steam within cavity 120. As the steam exits steam jet 126, it mixes with the pool water in cavity 120. The heated pool water flows out cover 124 and heats the main body of water 96. The water returning from the pool filter system replenishes the water in cavity 120.

While one or more embodiments of the present invention have been illustrated in detail, the skilled artisan will appreciate that modifications and adaptations to those embodiments may be made without departing from the scope of the present invention as set forth in the following claims.

What is claimed is:

1. A swimming pool heating system, comprising:

a swimming pool having a wall structure;

a network of pipes disposed within the wall structure of the swimming pool, the network of pipes having an opening to a main body of water in the swimming pool; and a steam jet coupled for receiving a source of steam, the steam jet being disposed within the network of pipes for injecting the steam to heat the main body of water in the swimming pool.

2. The swimming pool heating system of claim 1, further including:

a cavity formed in the wall structure of the swimming pool and exposed to the main body of water in the swimming pool, wherein the steam jet injects the steam into the cavity to heat the water in the swimming pool;

a protective plate disposed within the cavity for deflecting the steam; and a plurality of braces extending from an interior wall of the cavity to the protective plate for positioning the protective plate in the path of the steam jet to redirect and disperse the steam within the cavity.

3. The swimming pool heating system of claim 2, further including a grated cover plate covering an opening of the cavity into the swimming pool.

4. The swimming pool heating system of claim 2, further including a water pipe disposed within the cavity for replenishing water within the cavity.

5. The swimming pool heating system of claim 1, wherein the network of pipes is made from non-corrosive material.

6. A method of heating a swimming pool, comprising:

disposing a network of pipes within a wall structure of the swimming pool, the network of pipes having an opening to a main body of water in the swimming pool;

generating steam; and transporting the steam through the network of pipes to heat the main body of water in the swimming pool.

7. The method of claim 6, further including:

forming a cavity in the wall structure of the swimming pool, wherein the cavity is exposed to the main body of water in the swimming pool;

injecting the steam into the cavity to heat the water in the swimming pool;

disposing a protective plate within the cavity for deflecting the steam; and providing a plurality of braces extending from an interior wall of the cavity to the protective plate for positioning the protective plate in the path of the injected steam to redirect and disperse the steam within the cavity.

8. The method of claim 7, further including covering an opening of the cavity into the swimming pool with a grated cover plate.

9. The method of claim 7, further including disposing a water pipe within the cavity for replenishing water within the cavity.

10. The method of claim 6, wherein the network of pipes is made from non-corrosive material.

11. A swimming pool heating system, comprising:

a swimming pool;

a steam generator for generating steam;

a network of pipes coupled to the steam generator for transporting the steam, the network of pipes being disposed within a wall structure of the swimming pool and having an opening to a main body of water in the swimming pool; and a steam jet disposed within the network of pipes for injecting the steam to heat the water in the swimming pool.

12. The swimming pool heating system of claim 11, further including:

a cavity formed in the wall structure of the swimming pool and exposed to the main body of water in the swimming pool, wherein the steam jet injects the steam into the cavity to heat the water in the swimming pool;

a protective plate disposed within the cavity for deflecting the steam; and a plurality of braces extending from an interior wall of the cavity to the protective plate for positioning the protective plate in the path of the steam jet to redirect and disperse the steam within the cavity.

13. The swimming pool heating system of claim 12, further including a grated cover plate covering an opening of the cavity into the swimming pool.

14. The swimming pool heating system of claim 12, further including a water pipe disposed within the cavity for replenishing water within the cavity.

15. The swimming pool heating system of claim 11, wherein the network of pipes is made from non-corrosive material.

16. A water heating system for a swimming pool containing a main body of water, comprising:

a cavity formed in a wall structure of the swimming pool and exposed to the main body of water in the swimming pool, the cavity terminating at a surface of the wall structure of the swimming pool;

a steam jet disposed within the cavity for injecting steam into the cavity to heat the water in the swimming pool;

a protective plate disposed within the cavity for deflecting the steam; and a plurality of braces extending from an interior wall of the cavity to the protective plate for positioning the protective plate in the path of the steam jet to redirect and disperse the steam within the cavity.

17. The water heating system of claim 16, further including a grated cover plate covering an opening of the cavity into the swimming pool.

18. The water heating system of claim 16, further including:

a steam generator for generating steam; and a network of pipes coupled between the steam generator and the steam jet for transporting the steam, the network of pipes being disposed within a sidewall of the swimming pool.

19. The water heating system of claim 18, wherein the network of pipes is made from non-corrosive material.

20. The water heating system of claim 16, further including a water pipe disposed within the cavity for replenishing water within the cavity.

21. A water heating system for a swimming pool, comprising:

a steam generator for generating steam;

a network of pipes coupled to the steam generator for transporting the steam, the network of pipes being disposed within a sidewall of the swimming pool;

a cavity formed in the sidewall of the swimming pool and exposed to water from the swimming pool;

a steam jet disposed within the cavity and coupled to the network of pipes for injecting steam into the cavity to heat the water in the swimming pool;

a protective plate disposed within the cavity for deflecting the steam;

a plurality of braces extending from an interior wall of the cavity to the protective plate for positioning the protective plate in the path of the steam jet to redirect and disperse the steam within the cavity; and a grated cover plate covering an opening of the cavity into the swimming pool.

22. The water heating system of claim 21, wherein the network of pipes is made from non-corrosive material.

23. The water heating system of claim 21, further including a water return pipe disposed within the cavity for replenishing water within the cavity.

24. The water heating system of claim 21, wherein the grated cover plate is mounted flush with the sidewall of the swimming pool.

25. A water heating system, comprising:

a swimming pool having a sidewall;

a steam generator for generating steam;

a network of pipes coupled to the steam generator for transporting the steam, the network of pipes being disposed within the sidewall of the swimming pool;

a plurality of cavities formed in the sidewall of the swimming pool and exposed to water from the swimming pool, each cavity including, (a) a steam jet disposed within the cavity and coupled to the network of pipes for injecting steam into the cavity, (b) a water return pipe disposed within the cavity for replenishing water within the cavity, (c) a protective plate disposed within the cavity for deflecting the steam, and (d) a plurality of braces extending from an interior wall of the cavity to the protective plate for positioning the protective plate in the path of the steam jet to redirect and disperse the steam within the cavity which heats the water in the swimming pool.

26. The water heating system of claim 25, wherein the network of pipes is made from non-corrosive material.

27. The water heating system of claim 25, further including a grated cover plate covering an opening of the cavity into the swimming pool.

28. The water heating system of claim 25, wherein the grated cover plate is mounted flush with the sidewall of the swimming pool.

* * * * *